US009903185B2

(12) United States Patent
Ursi et al.

(10) Patent No.: US 9,903,185 B2
(45) Date of Patent: Feb. 27, 2018

(54) PERFORATING GUN WITH ECCENTRIC ROTATABLE CHARGE TUBE

(71) Applicant: Owen Oil Tools LP, Houston, TX (US)

(72) Inventors: Jeremy Ursi, Dallas, TX (US); Timothy E. LaGrange, Rainbow, TX (US); Brian Antal, Fort Worth, TX (US); William D. Hollis, Fort Worth, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 386 days.

(21) Appl. No.: 14/620,915

(22) Filed: Feb. 12, 2015

(65) Prior Publication Data

US 2015/0226044 A1 Aug. 13, 2015

Related U.S. Application Data

(60) Provisional application No. 61/938,886, filed on Feb. 12, 2014, provisional application No. 62/021,494, filed on Jul. 7, 2014.

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC ..... E21B 43/117; E21B 43/118; E21B 43/119
See application file for complete search history.

(56) References Cited

U.S. PATENT DOCUMENTS

| | | | | |
|---|---|---|---|---|
| 3,209,828 | A | 10/1965 | Lebourg | |
| 3,957,118 | A * | 5/1976 | Barry | E21B 23/14 166/385 |
| 3,982,594 | A * | 9/1976 | Berthiaume | E21B 10/18 175/325.4 |
| 4,153,118 | A | 5/1979 | Hart | |
| 4,410,051 | A | 10/1983 | Daniel et al. | |
| 4,438,810 | A | 3/1984 | Wilkinson | |
| 4,637,478 | A | 1/1987 | George | |
| 5,040,619 | A * | 8/1991 | Jordan | E21B 17/1057 166/241.1 |
| 5,211,714 | A | 5/1993 | Jordan et al. | |

(Continued)

FOREIGN PATENT DOCUMENTS

| | | |
|---|---|---|
| EP | 0452126 A2 | 10/1991 |
| WO | 0075485 A1 | 12/2000 |

(Continued)

OTHER PUBLICATIONS

PCT/US2015/015646—International Search Report dated May 18, 2015.

*Primary Examiner* — Robert E Fuller
(74) *Attorney, Agent, or Firm* — Mossman, Kumar & Tyler, PC

(57) ABSTRACT

A perforating gun includes an orienting device retained in a carrier and a charge tube rotatably connected to the orienting device. The orienting device misaligns a center axis of the charge tube with a different second axis such that gravity can cause the charge tube to rotate about the different second axis. The charge tube does not rotate about the center axis of the charge tube while the charge tube rotates about the different second axis.

13 Claims, 8 Drawing Sheets

(56) References Cited

U.S. PATENT DOCUMENTS

| | | | | |
|---|---|---|---|---|
| 5,273,121 | A | 12/1993 | Kitney et al. | |
| 5,603,379 | A | 2/1997 | Henke et al. | |
| 5,964,294 | A | 10/1999 | Edwards et al. | |
| 6,595,290 | B2 | 7/2003 | George et al. | |
| 6,942,033 | B2 | 9/2005 | Brooks et al. | |
| 7,114,564 | B2 | 10/2006 | Parrott et al. | |
| 7,497,259 | B2 | 3/2009 | Leising et al. | |
| 7,934,558 | B2 | 5/2011 | Hales et al. | |
| 8,002,035 | B2 | 8/2011 | Hales et al. | |
| 8,061,425 | B2 | 11/2011 | Hales et al. | |
| 8,066,083 | B2 | 11/2011 | Hales et al. | |
| 8,181,718 | B2 * | 5/2012 | Burleson | E21B 43/119 175/4.51 |
| 8,186,259 | B2 | 5/2012 | Burleson et al. | |
| 8,443,886 | B2 | 5/2013 | Torres et al. | |
| 8,684,083 | B2 | 4/2014 | Torres et al. | |
| 2002/0003040 | A1 | 1/2002 | Brunet | |
| 2002/0185275 | A1 * | 12/2002 | Yang | E21B 17/1057 166/297 |
| 2009/0145666 | A1 * | 6/2009 | Radford | E21B 10/30 175/269 |
| 2010/0230163 | A1 * | 9/2010 | Hales | E21B 43/119 175/4.51 |

FOREIGN PATENT DOCUMENTS

| | | | |
|---|---|---|---|
| WO | 03048523 | A1 | 6/2003 |
| WO | 03056129 | A1 | 7/2003 |
| WO | 03083248 | A2 | 10/2003 |
| WO | 2008067771 | A1 | 6/2008 |
| WO | 2009039389 | A1 | 3/2009 |
| WO | 2009076635 | A2 | 6/2009 |
| WO | 2010104634 | A2 | 9/2010 |
| WO | 2013188166 | A1 | 12/2013 |

* cited by examiner

PERFORATING GUN WITH ECCENTRIC ROTATABLE CHARGE TUBE

CROSS REFERENCE TO RELATED APPLICATIONS

This application claims priority from U.S. Provisional Application Ser. No. 61/938,886, filed Feb. 12, 2014 and from U.S. Provisional Application Ser. No. 62/021,494 filed on Jul. 7, 2014, the entire disclosures of which is incorporated herein by reference in their entirety.

TECHNICAL FIELD

The present disclosure relates to devices and method for perforating a subterranean formation.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating gun that is generally comprised of a steel tube "carrier," a charge tube riding on the inside of the carrier, and with shaped charges positioned in the charge tube. The gun is lowered into the wellbore on electric wireline, slickline, tubing, coiled tubing, or other conveyance device until it is adjacent to the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow through the perforations and into a production string.

In certain instances, it may be desirable to have the shaped charges point in a particular direction after the perforating gun is positioned in the wellbore. The present disclosure addresses the need for perforating guns that can point or direct the shaped charges in a desired direction in such situations.

SUMMARY

In aspects, the present disclosure provides a perforating gun for perforating a formation. The perforating gun may include a carrier, an orienting device retained in the carrier, and a charge tube rotatably connected to the orienting device. The orienting device misaligns a center axis of the charge tube with a different second axis such that gravity can cause the charge tube to rotate about the different second axis. The charge tube does not rotate about the center axis of the charge tube while the charge tube rotates about the different second axis. In one arrangement, the orienting device includes a decentralizer having a mandrel connected to the charge tube and an end plate, the end plate being rotatably connected to the hub and retained in the carrier. The different second axis may be one of: (i) a center axis of the carrier, (ii) a center axis of the end plate, and (iii) a center axis of the hub. The orienting device may include a bearing rotatably connecting the end plate to the hub.

It should be understood that certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
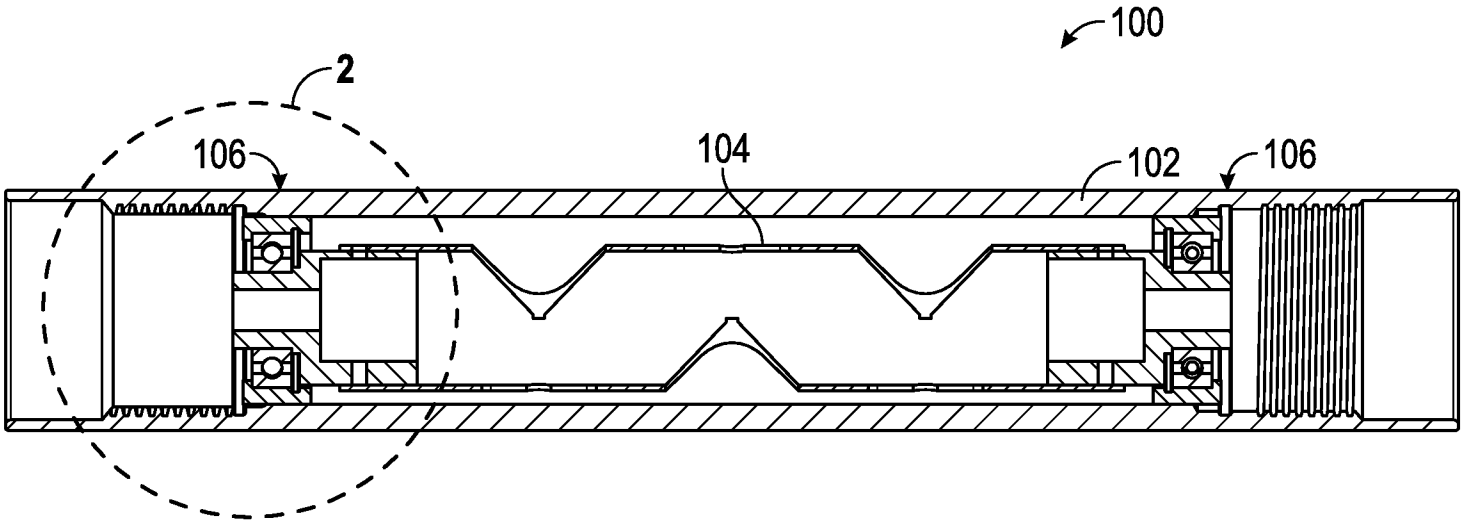
FIG. 1 schematically illustrates a side sectional view of a perforating gun with an eccentric rotatable charge tube according to one embodiment of the present disclosure.

The present disclosure relates to devices and methods for perforating a formation intersected by a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring now to FIG. 1, there is shown one embodiment of a perforating gun 100 in accordance with the present disclosure. For ease of discussion, devices such as shaped charges, boosters, electrical wiring, connectors, fasteners and detonating cords have been omitted. The perforating gun 100 may include a carrier 102 that is shaped to receive a charge tube 104. The perforating gun 100 also includes orienting devices 106 that allows the charge tube 104 to orient itself relative to gravity when positioned in the wellbore. In embodiments, an orienting device 106 is positioned on each of the opposing ends of the charge tube 104. While two orienting devices 106 are shown, it is contemplated that one orienting device 106 may also be used or that three or more orienting devices 106 may be used.

Figure 2:
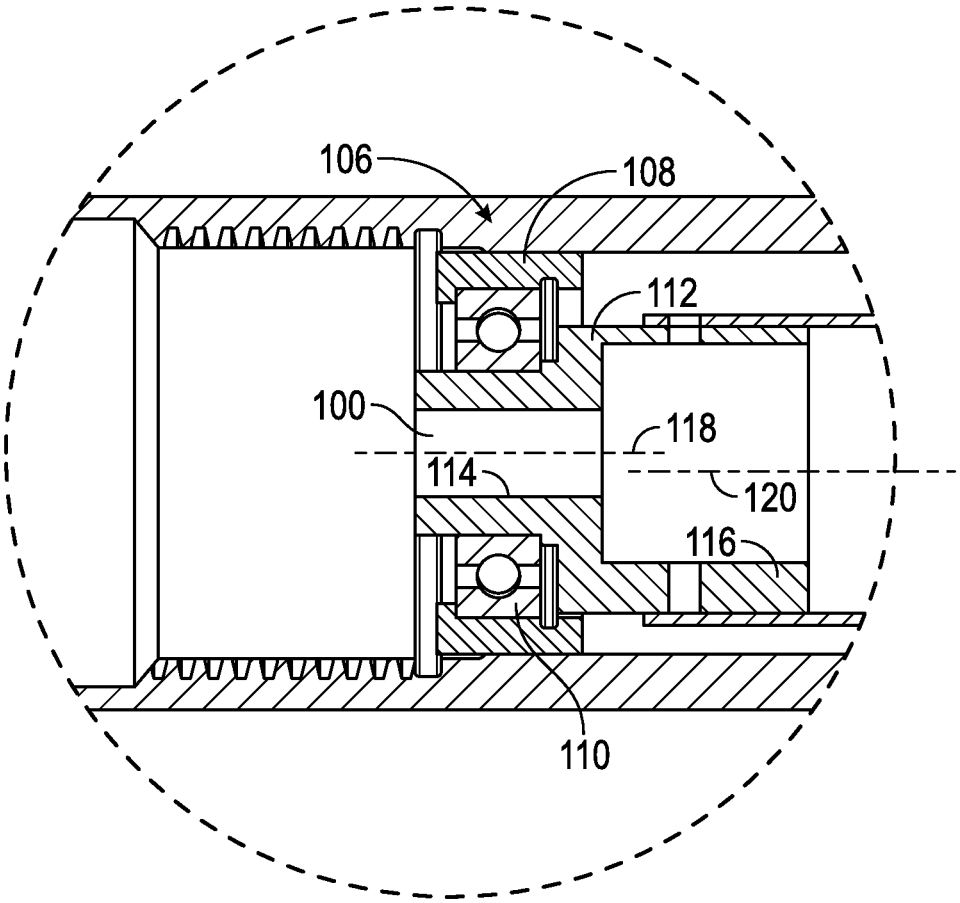
FIG. 2 schematically illustrates a sectional view of an orienting device according to one embodiment of the present disclosure.

Referring now to FIG. 2, there is shown a section of the perforating gun 100 that includes one non-limiting embodiment of an orienting device 106 according to the present disclosure. In this embodiment, the orienting device 106 includes an end plate 108, a bearing 110, and a decentralizer 112. The end plate 108 is retained in the carrier 102 and the decentralizer 112 is fixed to the charge tube 104. The bearing 110 rotatably connects the decentralizer 112 to the end plate 108. Thus, the decentralizer 112, which is connected to the charge tube 104, can rotate relative to the end plate 108, which is connected to the carrier 102.

The decentralizer 112 may be shaped and dimensioned to allow gravity to rotate the charge tube 104 relative to the carrier 102 when the perforating gun 100 is in a non-vertical alignment. In one embodiment, the decentralizer 112 has a hub 114 and a mandrel 116, both of which may be cylindrical in shape. A center axis 118 of the hub 114 and a center axis 120 of the mandrel 116 are eccentrically aligned. Thus, the charge tube 104 rotates, or in a sense orbits, about the center axis 118 of the hub 114. The charge tube 104 does not rotate about the center axis 120 of the mandrel 116. The center axis 120 aligns with the center axis of the charge tube 104. It should be appreciated that this axial misalignment shifts the center of gravity of the charge tube 104 a predetermined distance from the center axis 118. Thus, when in the non-vertical alignment, gravity can rotate the charge tube 104 about the axis 118. The center axis 118 may be the center axis of the carrier 102, the end plate 108, and/or the bearing 110 and the center axis 120 may be the center axis of the charge tube 104.

Figure 3:
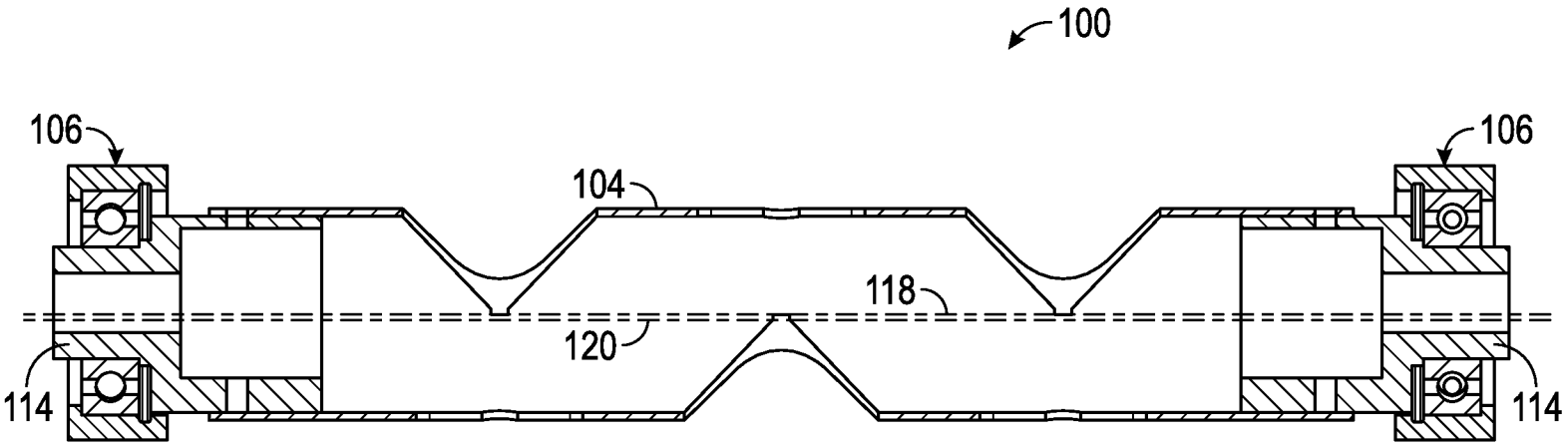
FIG. 3 schematically illustrates a side sectional view of a perforating gun with an eccentric rotatable charge tube according to one embodiment of the present disclosure that has a predetermined misalignment between charge tube axis and an axis of the carrier tube.

Referring now to FIG. 3, there is sectionally shown the perforating gun 100. The carrier 102 (FIG. 1) has been omitted for clarity. It should be appreciated that the orienting assemblies 106 cause the center axis 120 of the charge tube 104 to be misaligned, or eccentric, with the center axis 118 of the hub 114. Thus, a center of gravity of the charge tube 104 is shifted from concentric alignment with the center axis 118. When in a non-vertical position, such as a horizontal position, gravity will act to cause a moment arm to rotate the center of gravity to the lowest position. The misalignment is selected to form a sufficient moment arm length to allow gravity to act on the weight of the charge tube 104 to rotate the charge tube 104. Thus, the misalignment is specifically engineered to cause rotation of the charge tube 104 if the perforating gun 100 in a predetermined situation, e.g., the perforating gun is in a wellbore section that has a deviation from vertical greater than a specified value. The misalignment is not merely an artifact of conventional manufacturing and assembly.

Figure 4:
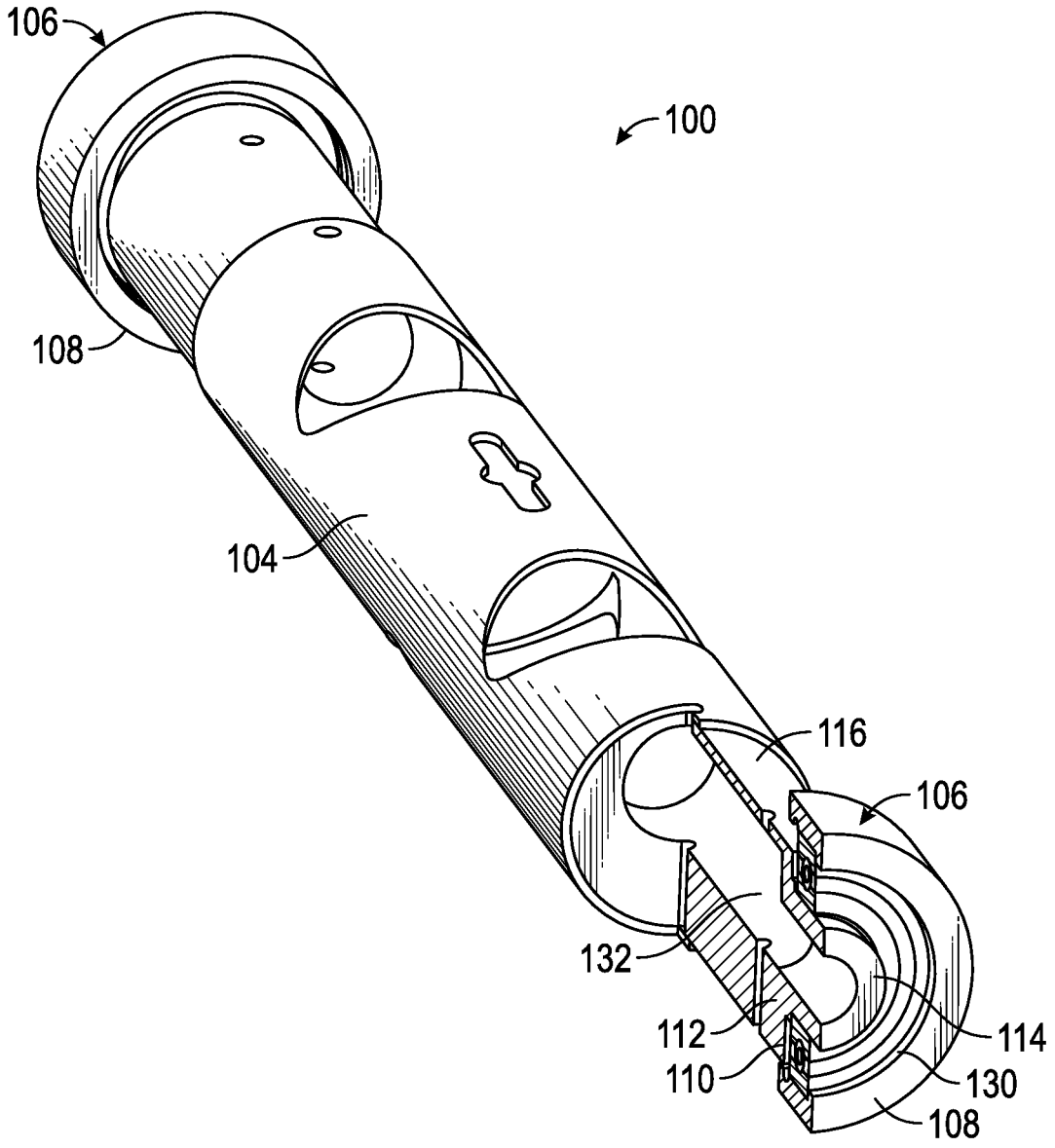
FIG. 4 schematically illustrates an isometric end sectional view of an orienting device according to one embodiment of the present disclosure.

Referring now to FIG. 4, there is isometrically shown the perforating gun 100. The carrier 102 (FIG. 1) has been omitted for clarity. As described above, an orienting device 106 is shown attached to each end of the charge tube 104. The end plates 108 may be ring shaped members that have a bore 130 in which the bearings 110 are disposed. The bearings 110 may be any device that permits relative rotation between two connected parts. Typically, but not always, the bearings 110 may include friction reducing elements such as spherical elements or highly polished surfaces. The two surfaces may be concentrically arranged such that the bearing 110 is positioned between them. The decentralizer 112 may include a passage 132 through the hub 114 and the mandrel 116. As shown, the passage 132 has two eccentrically aligned bores, each of which has a different size. However, the passage 132 may be of any desired configuration.

Figure 5:
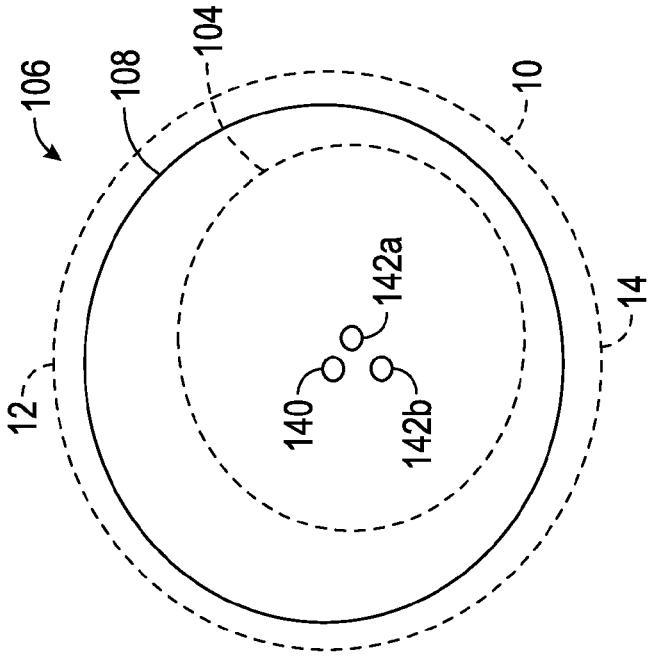
FIG. 5 schematically illustrates an end view of one embodiment of an orienting device according to the present invention.

Referring now to FIG. 5, there is shown an end view of the orienting device 106 positioned inside a wellbore 10. A wellbore high side or the twelve o'clock position is shown with numeral 12 and a wellbore low side or the six o'clock position is shown with numeral 14. Relative to gravity, the twelve o'clock position 12 is at a higher depth (true vertical depth) than the six o'clock position 14. The point 140 may be the center axis of the hub 114 (FIG. 2) which may be concentric with the center axis of the end plate 108. Point 142*a* may be the initial position of the center axis of the charge tube 104. Due to the misalignment of the points 140 and 142*a*, the center of gravity of the charge tube 104 is shifted. The distance between the location of the center of gravity of the charge tube 104 and the center axis of the hub 114 (FIG. 2) provide a moment arm that gravity acts on to rotate charge tube 104 until the center of gravity of the charge tube 104 substantially aligns with the six o'clock position 14. For convenience, the position of the axis of rotation of the charge tube 104 after rotation is shown with point 142*b*.

Referring back to FIG. 4, the charge tube 104 is generally configured to have a substantially uniformly distributed mass around the axis 120. That is, the charge tube 104 does not have any mass or weights that are specifically added to create a weight imbalance that could cause rotation about the axis 120. While a certain amount of weight variances may occur due to the distribution of shaped charges or other conventional components, such an imbalance does not induce a specified and predetermined rotation. Stated differently, the center of gravity of the charge tube 104 remains generally aligned with the center axis, or the axis of rotation, of the charge tube 104. In yet a different aspect, the weight distribution is not affected by devices intimately related to the firing of the shaped charges (not shown). Thus, it should further be noted that the charge tube 104 does not rotate about its own center axis 120.

The teachings of the present disclosure may also be used in other embodiments wherein eccentric axes are used for rotating entire gun systems. For example, an eccentric tandem sub that has external rollers may be used to orient the guns.

Figure 6:
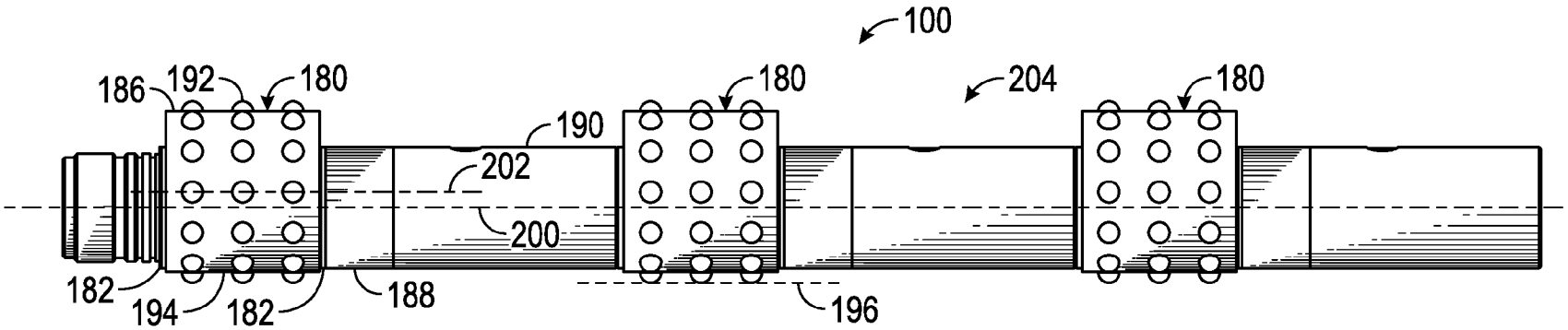
FIG. 6 schematically illustrates a side view of an external orienting device according to one embodiment of the present disclosure.

Referring FIG. 6, there is shown an embodiment of a perforating gun 100 that uses external rollers 180. A coiled tubing string 50 (FIG. 10) may be used to convey the perforating gun 100. A swivel or other rotational decoupler 64 (FIG. 10) may be used to allow the perforating gun 100 to rotate relative to the coiled tubing string 50 (FIG. 8) or other conveyance device. Each external roller 180 includes opposing two pin connections 182 that project from a collar 186. The pin connections 182 connect to box connections 188 of the carrier 190. As used herein, a "pin" refers to a projection such as a tube, rod or cylinder and a "box" refers to a bore or cavity shaped to receive the "pin." The collar 186 includes a plurality of roller elements 192 that are distributed on a circumferential face 194. The roller elements 192 contact an inner surface 196 of a wellbore tubular (not shown), such as casing or tubing. The roller elements 192 may be balls, spherical elements, or any other friction reducing elements that allow relative rotational movement between the gun 100 and the inner surface 196. The carrier 190 and the collar 186 are fixed to one another and rotate in unison.

Figure 7:
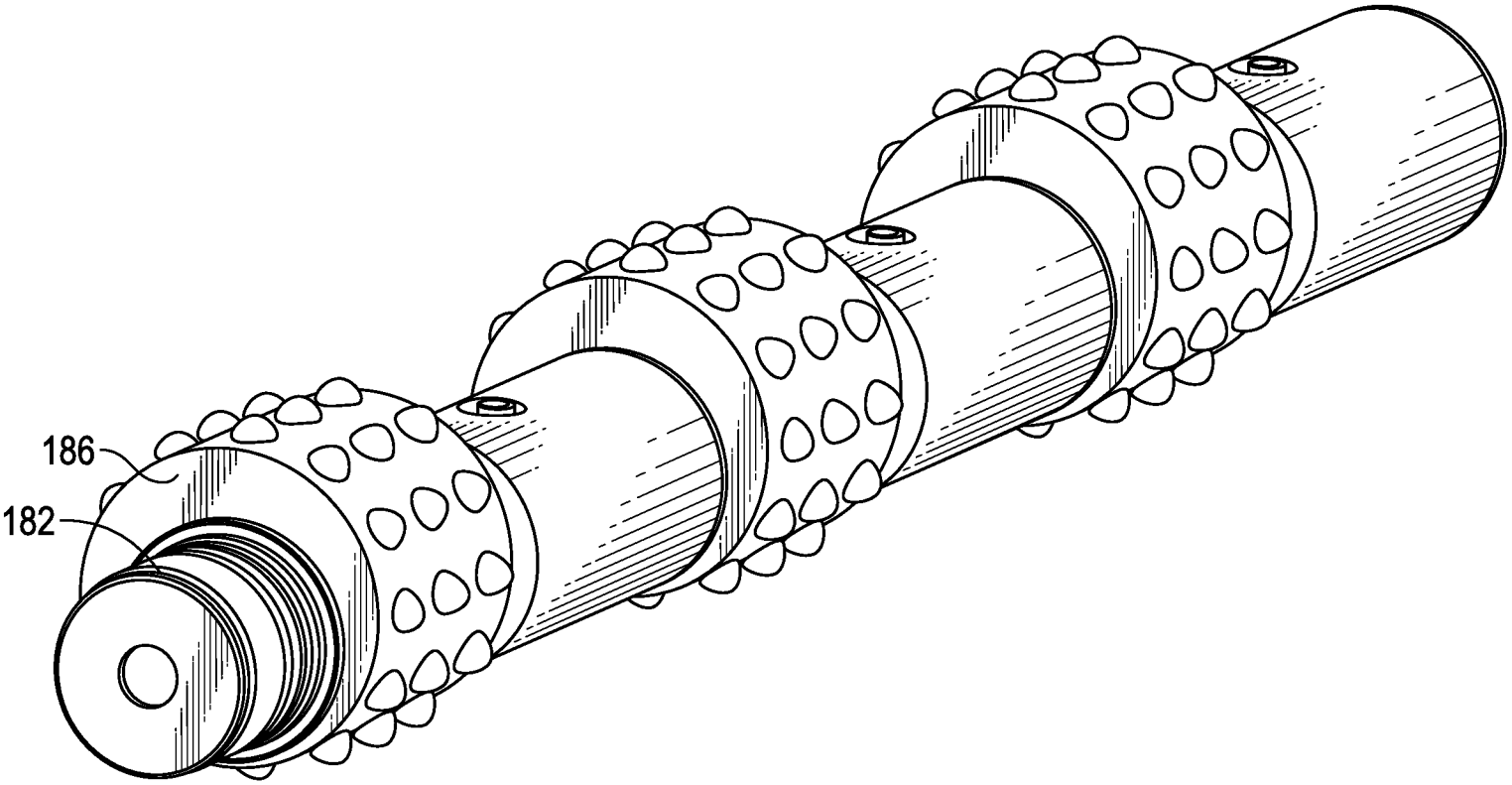
FIG. 7 schematically illustrates an end view of the FIG. 6 embodiment.

The axis 200 of the carrier 190 is decentralized relative to the axis 202 of the collar 186 to cause an eccentricity 204 of sufficient distance to allow gravity to rotate the perforating gun 100 relative to the wellbore tubular 196 when the perforating gun 100 is in a non-vertical alignment. In one embodiment, the pin connections 182 are positioned eccentric relative to the axis 202 of the collar 186. The eccentric relationship between the pin connections 182 and the collar 186 is shown in FIG. 7. Thus, the weight of the perforating gun 100 creates a moment arm around the axis 202 of the collar 186 and rotates the perforating gun 100 to align with wellbore low side.

Figure 8:
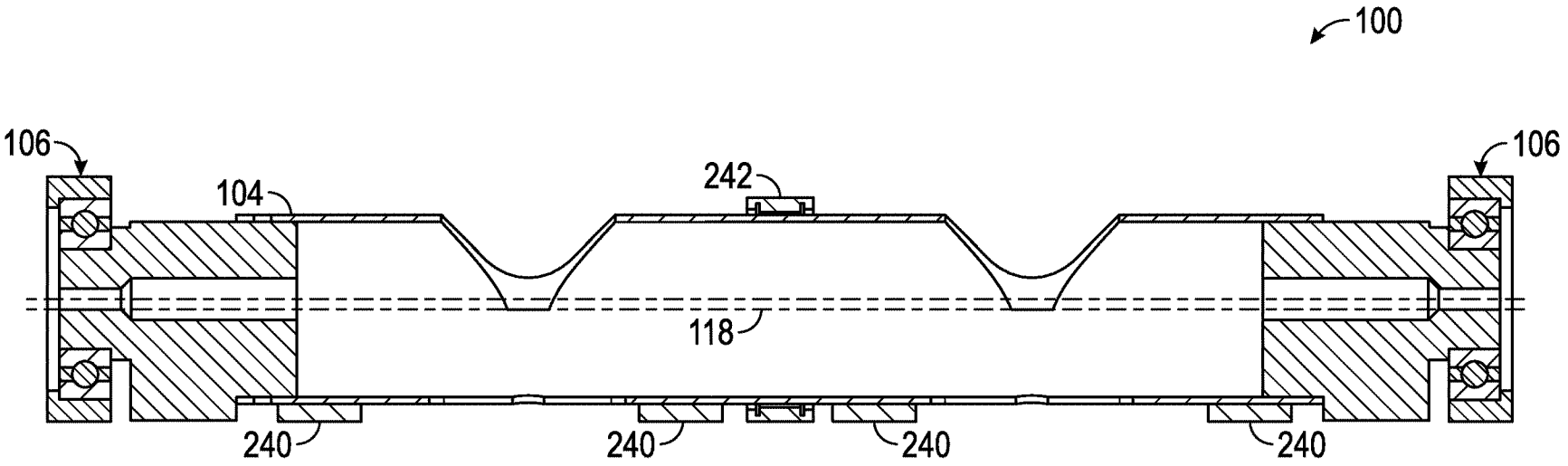
FIG. 8 schematically illustrates alternate embodiments of a perforating gun in accordance with the present disclosure.

Referring now to FIG. 8, there is sectionally shown another embodiment of a perforating gun 100 according to the present disclosure. As before, the carrier 102 (FIG. 1) has been omitted for clarity. In this embodiment, the perforating gun 100 is configured to accommodate perforating guns of extended lengths (e.g., five feet or more). For example, weights 240 may be added to the charge tube 104 in order to assist rotation. The weights 240 have no other function than to increase the mass on which gravity can act. Also, in addition to the bearings 110 (FIG. 2) in the orienting assemblies 106, intermediate supports 242 may be distributed along the charge tube 104. These supports 242 may be bearings, collars, centralizers, journals, polished surfaces, spherical elements, or any other elements that support weight and promote allow relative rotational movement between the gun 100 and the inner surface 196 (FIG. 7). The weights 240 and/or supports 242 may be used separately or together to reduce undesirable effects such as sagging or increased frictional resistance due to increased weight and length of the perforating gun 100 (FIG. 1). As in the previously discussed embodiments, the center of gravity of the charge tube 104 is shifted from concentric alignment with the center axis 118. Thus, when in a non-vertical position, such as a horizontal position, gravity will act to cause a moment arm to rotate the center of gravity to the lowest position.

Figure 9:
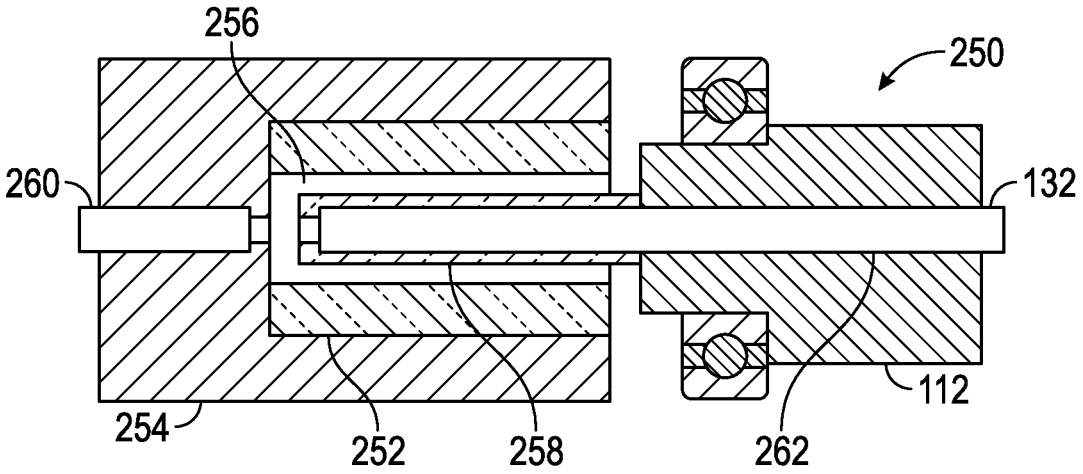
FIG. 9 schematically illustrates a connector in accordance with one embodiment of the present disclosure.

Referring now to FIG. 9, there is shown one embodiment of a connector assembly 250 that may be used to transfer energy and/or signals between a non-rotating carrier, such as coiled tubing or wireline, and the components of the perforating gun 100 (FIG. 1) that rotate, such as the equipment housed in the charge tube 104 (FIG. 2). In one arrangement, the connector assembly 250 includes an electrical contact assembly 252 that is enclosed within a housing 254. The electrical contact assembly 252 includes a cavity 256 for receiving an electrical contact tube 258.

The contact tube 258 is fixed to the rotating decentralizer 112 and may include electrically conductive bristles or brushes that physically contact the electrical contact assembly 252. The electrical connections may be formed by a first single or multi-strand wire (not shown) connected to the electrical contact assembly 252 and a second single or multi-strand wire (not shown) connected to the electrical contact tube 258. During operation, the electrical contact tube 258 rotates relative to the electrical contact assembly 252. An electrical connection is maintained by the physical contact of the surfaces of these two components.

The connector assembly 250 can also provide a ballistic connection between a non-rotating carrier and the rotating sections of the perforating gun 100 (FIG. 1). By "ballistic" connection, it is meant a connection that can detonate a energetic material using the energy released by a previously detonated energetic material, e.g., transferring a high-order detonation. As used herein, a high-order detonation is a detonation that produces high amplitude pressure waves (e.g., shock waves) and thermal energy. In one embodiment, a ballistic connection may be formed by positioning a first energetic component 260 in the housing 254 and positioning a second energetic component 262 inside the contact tube 258. The first energetic component 260 may include a detonator cord, a detonator, a booster charge, and/or other energetic materials. The second energetic component 262 may include a detonator cord, a detonator, a booster charge, and/or other energetic material materials. Illustrative energetic materials may include, materials such as oxidizers, fuels (e.g., metals, organic material, etc.), propellant materials (e.g., sodium nitrate, ammonium nitrate, etc.), explosive materials (e.g., RDX, HMX and/or HNS, etc.), binders and/or other suitable materials.

For arrangements where a single gun is used, a single connector 250 may be used. For example, an electrical signal carried by a wireline may be transferred from the electrical contact assembly 252 to electrical contact tube 285. The transferred signal may be used to detonate the second energetic component 262. In another arrangement, a pressure activated firing head (not shown) may be activated by increasing wellbore pressure. The pressure activated firing head detonates the first energetic component 260, which then detonates the second energetic component 262.

For gun trains having two or more guns, two or more connectors 250 may be used. For example, a connector 250 may be used at each decentralizer 112 (FIG. 3) across which an electrical signal or a detonation transfer is desired. In one arrangement, the first connector 250 initiates the firing of a first gun set using an electrical signal, and the remaining connectors 250 ballistically transfer the detonation between the gun sets. In another arrangement, two or more connector 250 initiates the firing of a first gun set using an electrical signal.

It should be appreciated that the connector 250 provides flexibility in how a perforating gun 100 may be run into a well. For coiled tubing run perforating guns 100, a pressure activated firing head may be used. For wireline run perforating guns 100, an electrically activated firing head may be used.

Figure 10:
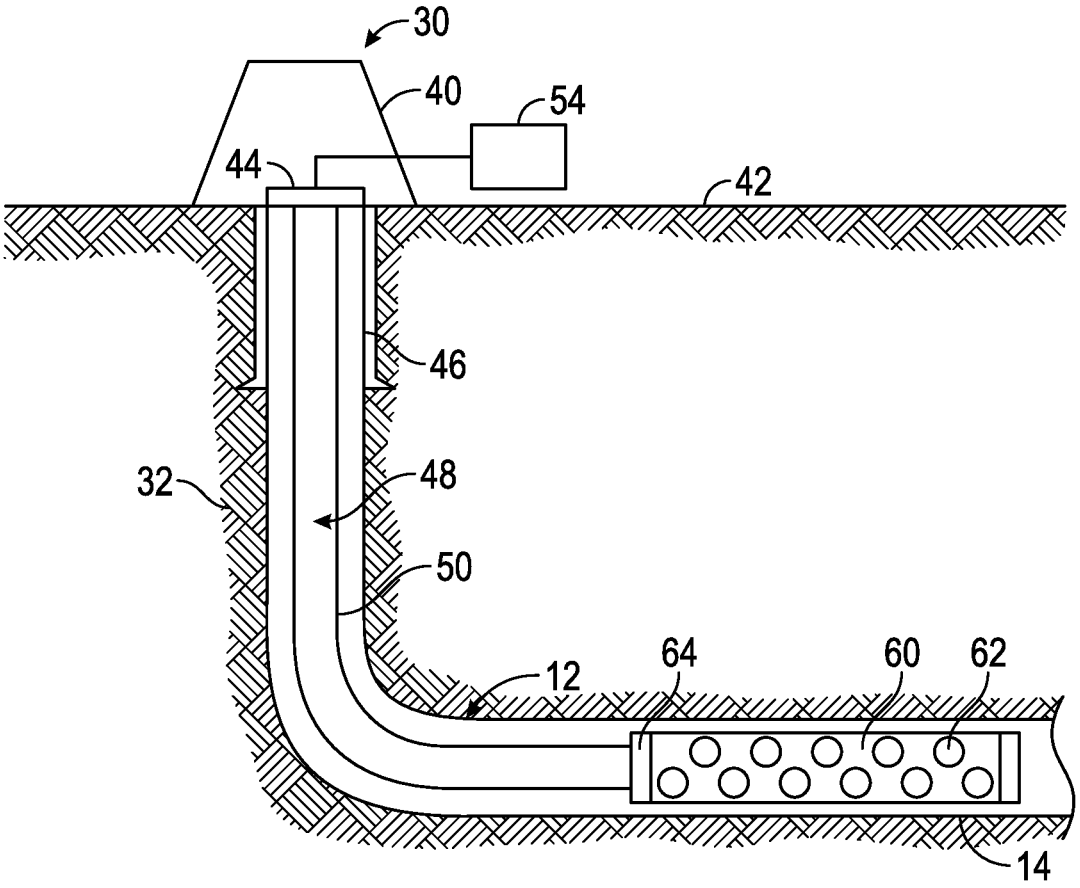
FIG. 10 schematically illustrates a well in which embodiments of the present disclosure may be deployed.

Referring initially to FIG. 10, there is shown a well construction and/or hydrocarbon production facility 30 positioned over subterranean formations of interest 32. The facility 30 can be a land-based or offshore rig adapted to drill, complete, or service the wellbore 12. The facility 30 can include known equipment and structures such as a platform 40 at the earth's surface 42, a wellhead 44, and casing 46. A work string 48 suspended within the well bore 12 is used to convey tooling into and out of the wellbore 12. The work string 48 can include coiled tubing 50 injected by a coiled tubing injector (not shown). Other work strings can include tubing, drill pipe, wire line, slick line, or any other known conveyance means. The work string 48 can include telemetry lines or other signal/power transmission mediums that establish one-way or two-way telemetric communication from the surface to a tool connected to an end of the work string 48. A suitable telemetry system (not shown) can be known types as mud pulse, electrical signals, acoustic, or other suitable systems. A surface control unit (e.g., a power source and/or firing panel) 54 can be used to monitor and/or operate tooling connected to the work string 48.

In one embodiment, a perforating tool such as a perforating gun train 60 is coupled to an end of the work string 48. An exemplary gun train 60 includes one or more guns or gun sets, each of which includes perforating shaped charges 62. In some embodiments, the work string 48 may include a swivel or rotational decoupler 64 that allows on or more sections of the perforating gun train 60 to rotate relative to the work string 48. The gun train 60 is disposed in a non-vertical section 14 of the wellbore 12. While the non-vertical section 14 is shown as horizontal, the non-vertical section 14 may have any angular deviation from a vertical datum.

Referring to FIGS. 1 and 5, in one illustrative method of use, when the gun train 60 is positioned in the non-vertical section 14, the misalignment between the center axis of the hub 114 (FIG. 2) and the center axis of the charge tube 104 allows gravity to act on a moment arm to rotate charge tube 104 until the center of gravity of the charge tube 104 substantially aligns with the six o'clock position 14. It should be appreciated that this rotation will allow the shaped charges (not shown) to be fired in any azimuthal direction relative to the wellbore high side. For example, the shaped charges (not shown) may be arranged to fire toward the wellbore high side, nine-degrees from wellbore high side, to the wellbore low side, etc.

In aspects, what has been described includes a perforating gun that includes a carrier and an orienting device connected to the carrier, wherein the orienting device misaligns a center axis of the carrier with a different second axis, and wherein gravity causes the charge tube to rotate about the different second axis while the carrier does not rotate about the center axis of the carrier.

From the above, it should be appreciated that what has been described includes a gravity oriented perforating gun. The perforating gun may include a charge tube disposed inside a carrier, a plurality of shaped charges positioned along the charge tube, and at least one orienting device positioned on each opposing end of the charge tube. Each orienting device may include an end plate retained in the carrier, a decentralizer fixed to the charge tube, and a bearing rotatably connecting the decentralizer to the end plate. The decentralizer includes a cylindrical hub and a cylindrical mandrel, a center axis of the hub and a center axis of the mandrel are eccentrically aligned, and the decentralizer rotates relative to the end plate.

This embodiment is susceptible to numerous variants. The charge tube may be fixed to the mandrel. A center axis of the charge tube may align with the center axis of the mandrel. The center axis of the hub may be a center axis of at least one of: (i) the carrier, (ii) the end plate, and (iii) the bearing, and the center axis of the mandrel may align with the center axis of the charge tube. The endplate may be a ring shaped member having a bore in which the bearing is received, and wherein the bearing has a bore in which the hub is received. The mandrel may be telescopically connected to the charge tube and a bore may extend through the mandrel and the hub. A connector assembly associated with the orienting device may include a housing, an electrical assembly fixed to the housing, and a contact tube rotatably connected to the electrical assembly and fixed to the decentralizer. The gun may include a first energetic component in the housing and a second energetic component in the contact tube. The first energetic component may include at least one of: (i) a detonator cord, (ii) a detonator, (iii) a booster charge, and (iv) an energetic material and the second energetic component may include at least one of: (i) a detonator cord, (ii) a detonator, (iii) a booster charge, and (iv) an energetic material. The gun may include (i) at least one weight positioned along the charge tube, and (ii) at least one support positioned along the charge tube.

Another perforating gun according to the present disclosure includes a carrier; and an orienting device connected to the carrier. The orienting device misaligns a center axis of the carrier with a different second axis. Gravity causes the charge tube to rotate about the different second axis while the carrier does not rotate about the center axis of the carrier. The orienting device may include at least one external roller. The gun may include a rotational decoupler connecting the carrier to a coiled tubing string. The external roller may include opposing pins that project from a collar, and wherein the carrier includes a box connecting to each pin. The collar may include a plurality of roller elements that are distributed on a circumferential face. The roller elements may be configured to contact an inner surface of a wellbore tubular. The carrier and the collar may be fixed to one another and rotate in unison. An axis of the carrier may be decentralized relative to the axis of the collar to cause an eccentricity of sufficient distance to allow gravity to rotate the carrier relative to the wellbore tubular when the carrier is in a non-vertical alignment. The pins may be positioned eccentric relative to an axis of the collar.

As used in this disclosure, the terms "aligned" means co-linear or concentric. Thus, axes that are aligned are concentric. Axes that are misaligned or eccentric are separated by a predetermined distance. As used in this disclosure, terms such as "substantially," "about," and "approximately" refer to the standard engineering tolerances that one skilled in the art of well tools would readily understand.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A perforating gun, comprising:

a carrier;

a charge tube disposed inside the carrier;

a plurality of shaped charges positioned along the charge tube; and at least one orienting device positioned on each opposing end of the charge tube, wherein each orienting device includes:

an end plate retained in the carrier;

a decentralizer fixed to the charge tube, wherein the decentralizer includes a cylindrical hub and a cylindrical mandrel, and wherein a center axis of the hub and a center axis of the mandrel are eccentrically aligned; and a bearing rotatably connecting the decentralizer to the end plate, wherein the decentralizer rotates relative to the end plate, the bearing having a center axis that is eccentrically aligned with the center axis of the mandrel.

2. The perforating gun of claim 1, wherein the charge tube is fixed to the mandrel.

3. The perforating gun of claim 2, wherein a center axis of the charge tube aligns with the center axis of the mandrel.

4. The perforating gun of claim 1, wherein the center axis of the hub is a center axis of at least one of: (i) the carrier, (ii) the end plate, and (iii) the bearing, and the center axis of the mandrel aligns with the center axis of the charge tube.

5. The perforating gun of claim 1, wherein the endplate is a ring shaped member having a bore in which the bearing is received, and wherein the bearing has a bore in which the hub is received.

6. The perforating gun of claim 1, wherein the mandrel is telescopically connected to the charge tube and wherein a bore extends through the mandrel and the hub.

7. The perforating gun of claim 1, further comprising a connector assembly associated with the at least one orienting device, the at least one connector assembly including a housing, an electrical assembly fixed to the housing, and a contact tube rotatably connected to the electrical assembly and fixed to the decentralizer.

8. The perforating gun of claim 7, further comprising a first energetic component in the housing and a second energetic component in the contact tube.

9. The perforating gun of claim 8, wherein the first energetic component includes at least one of: (i) a detonator cord, (ii) a detonator, (iii) a booster charge, and (iv) an energetic material and the second energetic component includes at least one of: (i) a detonator cord, (ii) a detonator, (iii) a booster charge, and (iv) an energetic material.

10. The perforating gun of claim 1, further comprising: (i) at least one weight positioned along the charge tube, and (ii) at least one support positioned along the charge tube.

11. A perforating gun, comprising:

a carrier;

a bearing fixed inside the carrier;

a charge tube disposed inside the carrier;

a plurality of shaped charges positioned along the charge tube;

at least one orienting device positioned inside the carrier and on each opposing end of the charge tube, wherein each orienting device includes:

an end plate retained in the carrier;

a decentralizer fixed to the charge tube, wherein the decentralizer includes a hub received within the bearing and a mandrel fixed to the charge tube, wherein a center axis of the hub and a center axis of the mandrel are eccentrically aligned, and wherein the charge tube rotates about the center axis of the hub; and a connector assembly associated with the at least one orienting device, the at least one connector assembly including a housing, an electrical assembly fixed to the housing, and a contact tube rotatably connected to the electrical assembly and fixed to the decentralizer.

12. The perforating gun of claim 11, wherein the charge tube is fixed to the mandrel, wherein a center axis of the charge tube aligns with the center axis of the mandrel, wherein the endplate is a ring shaped member having a bore in which the bearing is received, and wherein the bearing has a bore in which the hub is received.

13. The perforating gun of claim 11, wherein the charge tube has a substantially uniformly distributed mass around a center axis of the charge tube.

* * * * *